US007185875B1

(12) United States Patent
Jarrett

(10) Patent No.: US 7,185,875 B1
(45) Date of Patent: Mar. 6, 2007

(54) STEPS MADE EASY FOR CONCRETE ONLY

(76) Inventor: Samuel Jarrett, 8933 S. May, Chicago, IL (US) 60620

( * ) Notice: Subject to any disclaimer, the term of this patent is extended or adjusted under 35 U.S.C. 154(b) by 359 days.

(21) Appl. No.: 10/927,825

(22) Filed: Aug. 27, 2004

(51) Int. Cl.
*E04G 13/06* (2006.01)
*B28B 7/22* (2006.01)

(52) U.S. Cl. ..... 249/14; 249/208; 33/613

(58) Field of Classification Search ..... 249/8, 249/14, 34, 208; 33/613, 645, 518, 533, 33/535, 429, 451; 269/40, 43, 37, 904, 910
See application file for complete search history.

(56) References Cited

U.S. PATENT DOCUMENTS 1,319,385 A * 10/1919 Gottschalk ..... 249/208
1,725,827 A * 8/1929 Pontiere ..... 249/36
2,567,586 A * 9/1951 Werder ..... 269/43
3,284,042 A * 11/1966 Ingalise ..... 249/14
3,612,472 A 10/1971 Steigerwaldt, Jr.
3,729,765 A 5/1973 Peterson
4,237,614 A * 12/1980 Williams ..... 269/43
4,843,726 A * 7/1989 Ward ..... 33/613
4,846,437 A 7/1989 Fitzgerald
5,026,018 A 6/1991 Ayala
5,148,605 A * 9/1992 Julia ..... 269/43
5,407,182 A * 4/1995 Hartley ..... 269/43
6,178,586 B1 1/2001 Jafarmadar
6,457,913 B1 * 10/2002 Garten ..... 249/34
6,505,408 B1 1/2003 Talamantez

* cited by examiner

*Primary Examiner*—Michael Safavi

(57) ABSTRACT

An adjustable template apparatus for setting up risers in manufacturing concrete steps for enhancing the speed of set up for risers with regard to level and spacing. The adjustable template apparatus for setting up risers in manufacturing concrete steps includes a horizontal member having a first end and a second end; a first vertical member operationally coupled to the first end of the horizontal member, extending downwardly from the horizontal member, and is used to selectively abut a lower most riser; a riser positioning member slideably coupled to an underside of the horizontal member and positionable along a length of the horizontal member for selectively engaging a second riser; and a second vertical member slideably coupled to the horizontal member and positionable along a length of the horizontal member, the second vertical member extends upwardly from the horizontal member and is user for selectively abutting a third riser.

13 Claims, 4 Drawing Sheets

STEPS MADE EASY FOR CONCRETE ONLY

I. BACKGROUND OF THE INVENTION

The present invention relates to concrete forms and more particularly pertains to a new adjustable template apparatus for setting up risers in manufacturing concrete steps for enhancing the speed of set up for risers with regard to level and spacing.

II. DESCRIPTION OF THE PRIOR ART

The use of concrete forms is known in the prior art. Illustrative examples include: U.S. Pat. No. 3,612,472; U.S. Pat. No. 4,846,437; and U.S. Pat. No. 5,026,018.

While these devices fulfill their respective, particular objectives and requirements, the need remains for a apparatus which facilitates quick setup of risers in a level and evenly space fashion.

III. SUMMARY OF THE INVENTION

Concrete is unbeatable for making smooth, flat, and strong, all weather surfaces such as pads, floors, walls, and steps. Concrete is a moistened mixture of three dry ingredients: Portland cement, sand and crushed stone, in roughly a 1-2-4 blend. Prior to pouring concrete for any type of project, the site the concrete is to be poured on must be prepared and a form erected. Erecting the form is critical and time consuming as the form must be laid out accurately, in the correct dimensions, and level. Correctly building a form can be time consuming and tedious as numerous measurements must be taken, using a tape measure to define the dimensions and a bubble level to ensure the form is level. A relatively small project which requires a lot of time and effort to correctly erect a form is pouring concrete steps, due to the number of riser boards that are used. The present invention addresses these difficulties by providing an innovative and practical template that would make erecting a form for concrete steps much easier and less time consuming.

The invention would most preferably be produced from durable, rust resistant metal materials and would be comprised of a horizontal member with a vertical member projecting upward from one end and a riser positioning member attached to the underside. Quite importantly, a bubble level may be attached to and is preferably integrated with the upper surface of the horizontal member. The horizontal member has a length of two feet and the vertical extension projects upward for seven inches. The riser positioning member is a metal bracket with two downward projecting arms that could be varied in position along the length of the horizontally positioned bar.

Use of the invention would be very straightforward and would greatly facilitate the task of properly positioning riser boards for forming concrete steps, prior to concrete being poured. The adjustable mounting clip, which would be clipped onto the lowest riser board, would be adjusted to establish the distance between riser boards, defining the depth of each step that is to be formed. The positioning of the riser board for the next higher step is established by the vertical extension that projects upward at a 90 degree angle from the end of the horizontal member. The integrally attached bubble level would be used to ensure that the horizontally positioned bar and riser boards are level. A second instance of the invention could be configured and used in the same manner on the opposite end of the riser board to ensure the board was correctly positioned and leveled on both ends. After the first riser has been positioned the remaining riser would basically be automatically positioned by the invention. As illustrated by the preceding text, the invention would make the task of forming concrete steps much easier to accomplish and less time consuming.

To this end, the present invention generally comprises a horizontal member having a first end and a second end; a first vertical member operationally coupled to the first end of the horizontal member, extending downwardly from the horizontal member, and is used to selectively abut a lower most riser; a riser positioning member slideably coupled to an underside of the horizontal member and positionable along a length of the horizontal member for selectively engaging a second riser; and a second vertical member slideably coupled to the horizontal member and positionable along a length of the horizontal member, the second vertical member extends upwardly from the horizontal member and is user for selectively abutting a third riser.

There has thus been outlined, rather broadly, the more important features of an adjustable template apparatus in order that the detailed description thereof that follows may be better understood, and in order that the present contribution to the art may be better appreciated. There are additional features of the adjustable template apparatus that will be described hereinafter and which will form the subject matter of the claims appended hereto.

In this respect, before explaining at least one embodiment of the adjustable template apparatus in detail, it is to be understood that the adjustable template apparatus is not limited in its application to the details of construction and to the arrangements of the components set forth in the following description or illustrated in the drawings. The adjustable template apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present adjustable template apparatus. It is important, therefore, that the claims be regarded as including such equivalent constructions insofar as they do not depart from the spirit and scope of the present invention.

It is another object of the present invention to provide an adjustable template apparatus which has all of the advantages of the prior art and none of the disadvantages.

It is another object of the present invention to provide an adjustable template apparatus which may be easily and efficiently manufactured and marketed.

It is another object of the present invention to provide an adjustable template apparatus which is of durable and reliable construction.

It is yet another object of the present invention to provide an adjustable template apparatus which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
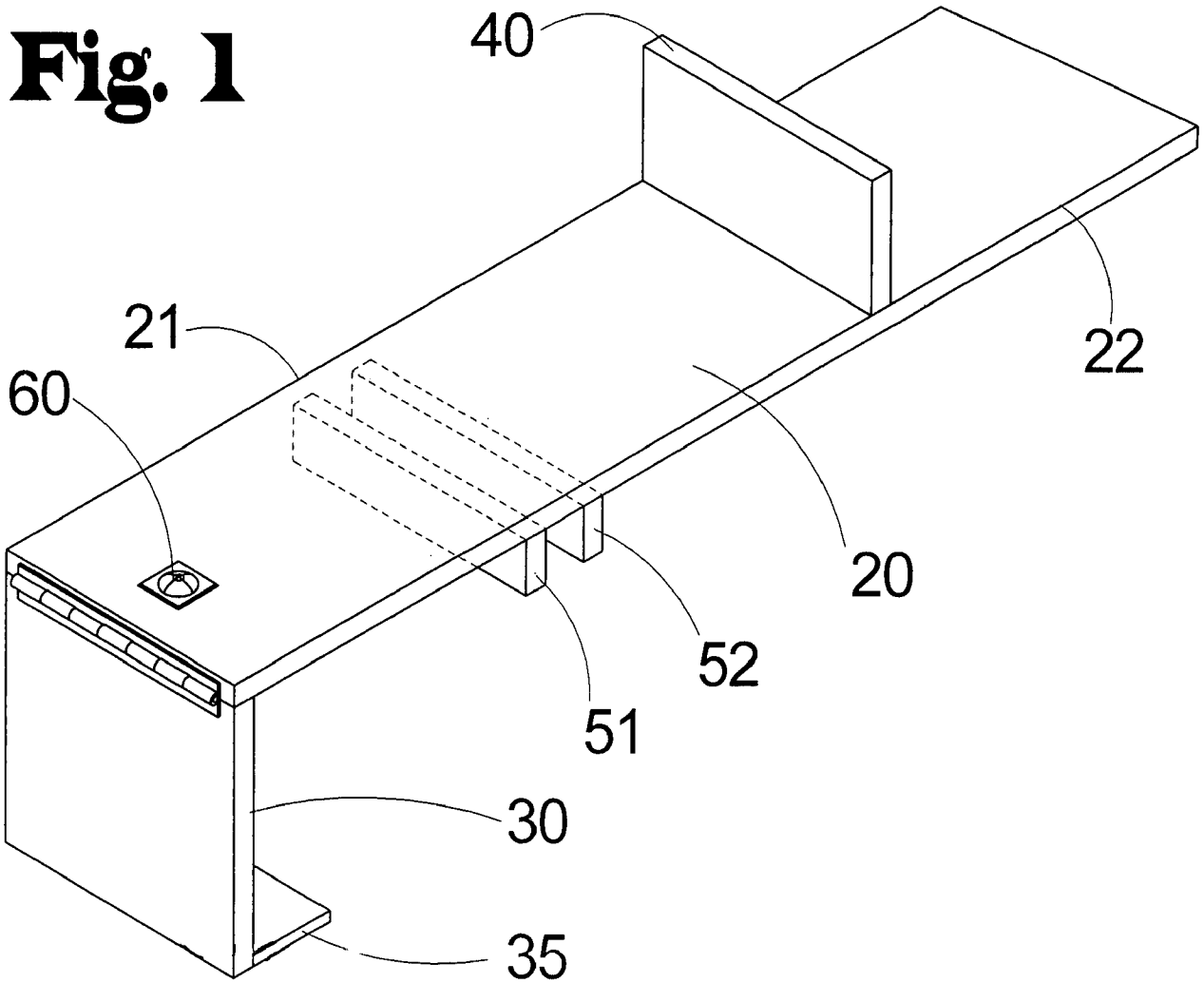
FIG. 1 is a schematic perspective view of a new adjustable template apparatus for setting up risers in manufacturing concrete steps according to the present invention.
Figure 2:
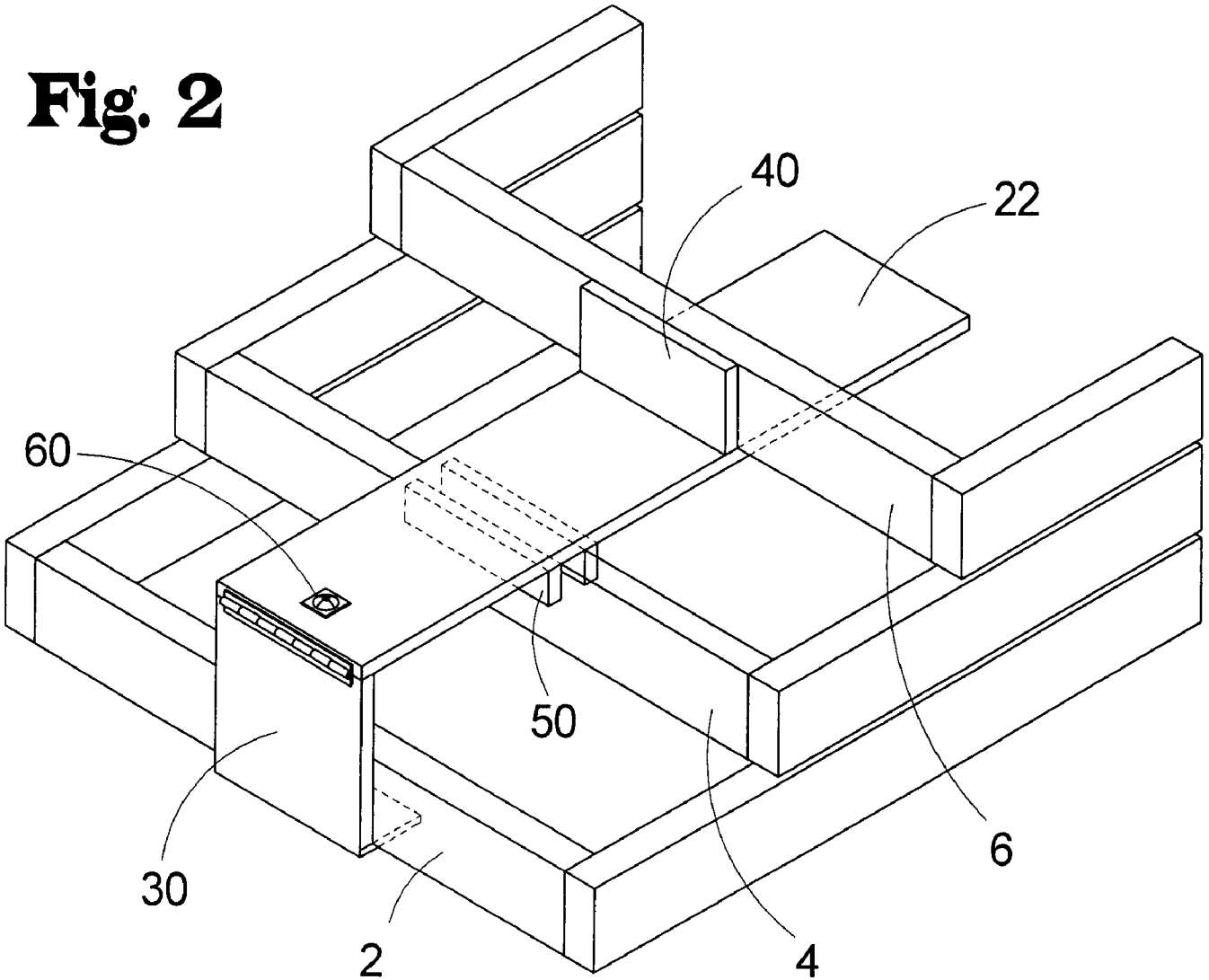
FIG. 2 is a schematic perspective view of the present invention in use.
Figure 3:
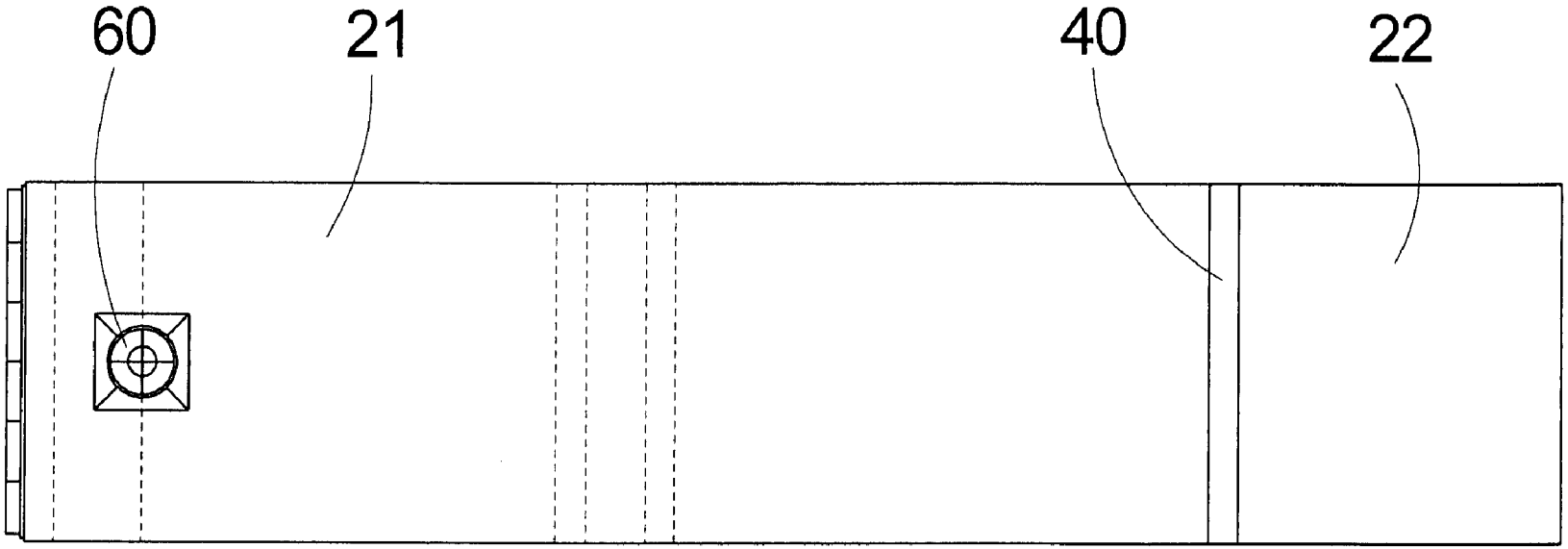
FIG. 3 is a schematic top view of the present invention.
Figure 4:
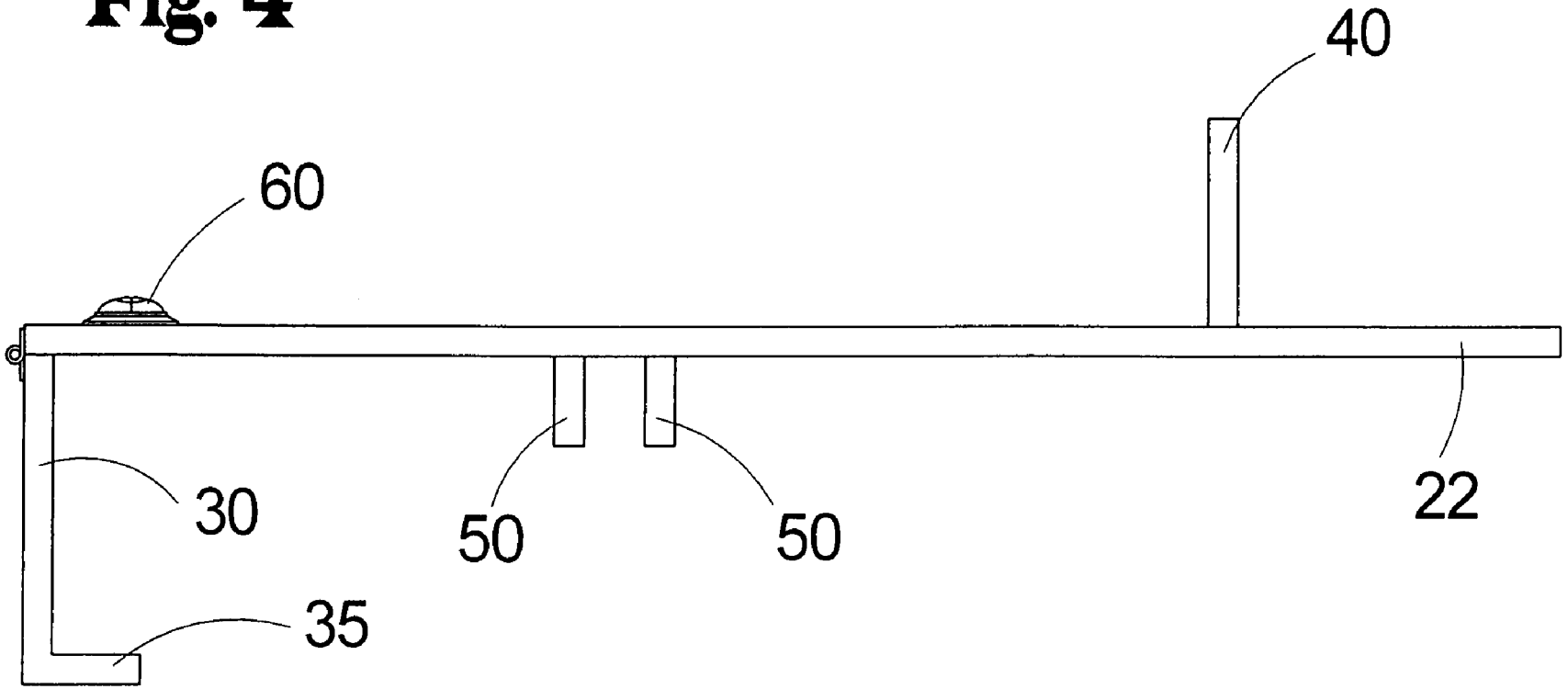
FIG. 4 is a schematic side view of the present invention.

With reference now to the drawings, and in particular to FIGS. 1 through 4 thereof, a new adjustable template apparatus for setting up risers in manufacturing concrete steps embodying the principles and concepts of the present invention and generally designated by the reference numeral 10 will be described.

As best illustrated in FIGS. 1 through 4, the adjustable template apparatus for setting up risers in manufacturing concrete steps 10 generally comprises a horizontal member 20, a first vertical member 30, a riser positioning member 50, and a second vertical member 40.

The horizontal member 20 includes a first end 21 and a second end 22. The first vertical member 30 is operationally coupled to the first end 21 of the horizontal member 20 and extends downwardly from the horizontal member 20. The first vertical member 30 is used to selectively abut a lower most riser 2. The riser positioning member 50 is slideably coupled to an underside of the horizontal member 20 and is positionable along a length of the horizontal member 20. The riser positioning member 50 selectively engages a second riser 4. The second vertical member 40 is also slideably coupled to the horizontal member 20 and is positionable along a length of the horizontal member 20. The second vertical member 40 extends upwardly from the horizontal member 20 and is used for selectively abutting a third riser 6.

In an embodiment, the first vertical member 30 is coupled to the first end 21 of the horizontal member 20 by a hinge or pivot to facilitate storage of the apparatus 10.

In a further embodiment, a bubble level 60 is operationally coupled to the horizontal member 20 and is observable from a top side of the horizontal member 20. The bubble level 60 provides a visual indication of the horizontal member's 20 position as referenced to level in two axes. Most preferably, the bubble level 60 is integrated into the horizontal member 20.

In yet a further embodiment, a second horizontal member 35 is operationally coupled to the first vertical member 30. The second horizontal member 35 is positionable underneath the lower most riser 2 to inhibit tipping of the horizontal member 20 as the third riser 6 is positioned on the horizontal member 20.

In still a further embodiment, the riser positioning member 50 includes a first portion 51 and a second portion 52. The first portion 51 is designed for engaging a leading edge of the second riser 4; and the second portion 52 is designed for engaging a trailing edge of the second riser 4.

In still yet a further embodiment the apparatus 10 is made out of a corrosion resistant metal.

In an embodiment the horizontal member 20 has a length of approximately two feet and the second vertical member 40 has a height of approximately seven inches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An adjustable template apparatus for setting up risers in manufacturing concrete steps, comprising:

(a) a horizontal member having a first end and a second end, (b) a first vertical member operationally coupled to said first end of said horizontal member, said first vertical member extending downwardly from said horizontal member, said first vertical member selectively abutting a lower most riser, (c) a riser positioning member slideably coupled to an underside of said horizontal member, said riser positioning member being positionable along a length of said horizontal member, said riser positioning member selectively engaging a second riser, and (d) a second vertical member slideably coupled to said horizontal member, said second vertical member being positionable along a length of said horizontal member, said second vertical member extending upwardly from said horizontal member, said second vertical member selectively abutting a third riser.

2. The adjustable template apparatus of claim 1, further comprising a bubble level operationally coupled to said horizontal member, said bubble level being observable from a top side of said horizontal member, said bubble level providing a visual indication of said horizontal members position as referenced to level in two axes.

3. The adjustable template apparatus of claim 1, wherein said first vertical member being hingeably coupled to said first end of said horizontal member to facilitate storage of said apparatus.

4. The adjustable template apparatus of claim 1, further comprising a second horizontal member operationally coupled to said first vertical member, said second horizontal member being positionable underneath the lower most riser to inhibit tipping of said horizontal member as the third riser is positioned on said horizontal member.

5. The adjustable template assembly of claim 1, wherein said riser positioning member further comprises a first portion and a second portion, said first portion being adapted for engaging a leading edge of said second riser, said second portion being adapted for engaging a trailing edge of said second riser.

6. The adjustable template assembly of claim 1, wherein said horizontal member, first vertical member, second vertical member, and said riser positioning member comprises a corrosion resistant metal.

7. The adjustable template assembly of claim 1, wherein said horizontal member has a length of approximately two feet and said second vertical member has a height of approximately seven inches.

8. An adjustable template apparatus for setting up risers in manufacturing concrete steps, the adjustable template apparatus comprising:

(a) a horizontal member having a first end and a second end, (b) a first vertical member operationally coupled to said first end of said horizontal member, said first vertical member extending downwardly from said horizontal member, said first vertical member selectively abutting a lower most riser, said first vertical member being hingeably coupled to said first end of said horizontal member to facilitate storage of said apparatus, (c) a riser positioning member slideably coupled to an underside of said horizontal member, said riser positioning member being positionable along a length of said horizontal member, said riser positioning member selectively engaging a second riser, (d) a second vertical member slideably coupled to said horizontal member, said second vertical member being positionable along a length of said horizontal member, said second vertical member extending upwardly from said horizontal member, said second vertical member selectively abutting a third riser, and (e) a bubble level operationally coupled to said horizontal member, said bubble level being observable from a top side of said horizontal member, said bubble level providing a visual indication of said horizontal members position as referenced to level in two axes.

9. The adjustable template apparatus of claim 8, further comprising a second horizontal member operationally coupled to said first vertical member, said second horizontal member being positionable underneath the lower most riser to inhibit tipping of said horizontal member as the third riser is positioned on said horizontal member.

10. The adjustable template assembly of claim 8, wherein said riser positioning member further comprises a first portion and a second portion, said first portion being adapted for engaging a leading edge of said second riser, said second portion being adapted for engaging a trailing edge of said second riser.

11. The adjustable template assembly of claim 8, wherein said horizontal member, first vertical member, second vertical member, and said riser positioning member comprises a corrosion resistant metal.

12. The adjustable template assembly of claim 8, wherein said horizontal member having a length of approximately two feet and said second vertical member having a height of approximately seven inches.

13. The adjustable template assembly of claim 8, further comprising:

(a) a second horizontal member operationally coupled to said first vertical member, said second horizontal member being positionable underneath the lower most riser to inhibit tipping of said horizontal member as the third riser is positioned on said horizontal member, (b) wherein said riser positioning member further comprises a first portion and a second portion, said first portion being adapted for engaging a leading edge of said second riser, said second portion being adapted for engaging a trailing edge of said second riser, (c) wherein said horizontal member, first vertical member, second vertical member, and said riser positioning member comprises a corrosion resistant metal, and (d) wherein said horizontal member having a length of approximately two feet and said second vertical member having a height of approximately seven inches.

* * * * *